US010861353B2

(12) United States Patent
Anzà

(10) Patent No.: US 10,861,353 B2
(45) Date of Patent: Dec. 8, 2020

(54) ARTICLE CONFIGURED TO REPRODUCE A PREDETERMINED IMAGE WITH THREE-DIMENSIONAL EFFECT AND METHOD FOR PRODUCING SAID ARTICLE

(71) Applicant: Pierfrancesco Anzà, Rome (IT)

(72) Inventor: Pierfrancesco Anzà, Rome (IT)

( * ) Notice: Subject to any disclaimer, the term of this patent is extended or adjusted under 35 U.S.C. 154(b) by 0 days.

(21) Appl. No.: 16/487,660

(22) PCT Filed: Feb. 26, 2018

(86) PCT No.: PCT/IT2018/050028
§ 371 (c)(1),
(2) Date: Aug. 21, 2019

(87) PCT Pub. No.: WO2018/154620
PCT Pub. Date: Aug. 30, 2018

(65) Prior Publication Data

US 2020/0066187 A1 Feb. 27, 2020

(30) Foreign Application Priority Data

Feb. 27, 2017 (IT) ..... 102017000021981

(51) Int. Cl.
*G09F 1/06* (2006.01)
*B42D 15/00* (2006.01)
*B42D 15/04* (2006.01)

(52) U.S. Cl.
CPC ..... *G09F 1/06* (2013.01); *B42D 15/008* (2013.01); *B42D 15/045* (2013.01)

(58) Field of Classification Search
CPC ..... G09F 1/06; B42D 15/008
See application file for complete search history.

(56) References Cited

U.S. PATENT DOCUMENTS 371,900 A * 10/1887 Pihlstrom ..... A63H 33/16 446/488
1,244,959 A * 10/1917 Conover ..... G09F 19/00 40/444

(Continued)

FOREIGN PATENT DOCUMENTS

DE 37 04 393 C1 5/1988
GB 598 336 2/1948

(Continued)

OTHER PUBLICATIONS

Search report dated Dec. 5, 2017 in Italian Application No. 1 0201 7000021 981 in 9 pages.

(Continued)

*Primary Examiner* — Gary C Hoge
(74) *Attorney, Agent, or Firm* — Knobbe Martens Olson & Bear LLP

(57) ABSTRACT

The present invention relates to an article (C) configured for reproducing a predetermined image with three-dimensional effect. Said article (C) comprising a succession of sheets (1,2,3) and said succession of sheets (1,2,3) comprising at least a first sheet (1) having a first surface (1A) on which a first part (11) of said predetermined image is shown, and a second surface (1B), opposite to said first surface (1A), as well as a second sheet (2) having a first surface (2A), on which a second part (12) of said predetermined image is shown, and a second surface (2B), opposite to said first surface (2A), where said second part (12) of said predetermined image comprising a first portion (12A) showing a first image reproducing said first part (11) of said predetermined image in shadow, and a second portion (12B) showing a second image, different from said first image. Said first sheet (1) has at least one opening or portion of transparent material (100) having predetermined dimensions, and said article (C) is configured in such a way that, when in use, said second (Continued)

sheet (2) is parallel or substantially parallel to said first sheet (1) and is aligned to said first sheet (1) along an axis (A), said axis (A) being perpendicular to said first sheet (1) and to said second sheet (2), said first surface (2A) of said second sheet (2) is at a predetermined first distance from the second surface (1B) of said first sheet (1), said at least one opening or portion of transparent material (100) is arranged with respect to the first surface (2A) of said second sheet (2) in such a way that said second portion (12B) of said second part (12) is visible from the outside and the projection along said axis (A) of said first part (11) of said predetermined image shown on the first surface (1A) of said first sheet (1) falls on the first surface (2A) of said second sheet (2) substantially in correspondence of said first portion (12A) of said second part (12). The present invention relates also to a method for producing said article.

12 Claims, 9 Drawing Sheets

(56) References Cited

U.S. PATENT DOCUMENTS 1,499,891 A * 7/1924 Storer ..... G09F 1/06 40/124.08
2,016,129 A * 10/1935 Williamson ..... G09F 1/06 40/539
2,203,578 A * 6/1940 Podmore ..... B42D 15/04 40/124.09
2,544,783 A * 3/1951 Freedman ..... B42D 1/004 281/38
2,988,845 A * 6/1961 MacDougall ..... B42D 15/045 40/445
3,090,144 A * 5/1963 Malamude ..... G09F 1/06 40/124.08
3,829,998 A * 8/1974 Flax ..... B42D 15/042 40/800
4,885,859 A 12/1989 Gasser
5,317,823 A * 6/1994 Brunt, II ..... G09F 1/08 206/308.1
5,386,656 A * 2/1995 Bergman ..... G09F 1/08 40/124.08
5,522,754 A * 6/1996 Hanson ..... A63H 33/22 40/427
5,562,520 A * 10/1996 Pridonoff ..... A63H 3/52 40/124.14
6,163,991 A * 12/2000 Drapcho ..... G09F 1/06 283/117
2012/0285860 A1* 11/2012 Glass ..... B42D 15/045 206/767
2015/0128462 A1* 5/2015 Crowell ..... G09F 1/06 40/124.09

FOREIGN PATENT DOCUMENTS

GB 2 031 288 4/1980
JP 2000-153700 6/2000
WO WO 2008/119142 10/2008

OTHER PUBLICATIONS

International Search Report and Written Opinion dated May 24, 2018 in International Application No. PCT/IT2018/050028 in 11 pages.

* cited by examiner

ARTICLE CONFIGURED TO REPRODUCE A PREDETERMINED IMAGE WITH THREE-DIMENSIONAL EFFECT AND METHOD FOR PRODUCING SAID ARTICLE

The present invention relates to an article configured to reproduce a predetermined image with three-dimensional effect.

More specifically, the invention relates to an article which allows to represent a predetermined image in such a way that an observer, when looking at said predetermined image, has a high sensation of depth.

Currently, several articles are known to reproduce an image with a three-dimensional effect, such as for example three-dimensional postcards generally defined as pop-up.

A first example of a three-dimensional postcard of known type consists of a single sheet consisting of a first part and a second part, arranged side by side to the first part and connected to said first part by means of a folding line.

Said sheet moves from a first position, in which it is closed and said two parts are substantially overlapped on each other and in contact with each other, to a second position, in which said sheet is open and said second part forms a predetermined angle with said first part, and vice versa.

An image is arranged on a portion of said sheet, for example straddling said first part and said second part or on one of said two parts, and said sheet portion is connected by further sheet portions to said sheet in such a way to be raised and visible when said sheet is in said second position, i.e. when said sheet is open.

A disadvantage of said first example of three-dimensional postcard of known type is given by the fact that the visual effect generated in an observer is such that the observer perceives an image that does not reflect the real image, due to said further portions of sheet connecting the sheet portion on which the image is represented with the sheet itself.

Consequently, the three-dimensional effect generated by said first example of three-dimensional postcard of known type is limited.

A second example of three-dimensional postcard of known type is constituted by a plurality of sheets, on each of which a respective image is shown, connected to each other by means of supporting means so that said three-dimensional postcard moves from a first position, wherein said three-dimensional postcard has a substantially flat shape and said sheets are substantially overlapped on each other and in contact with each other, to a second position, wherein said postcard has a three-dimensional shape and said sheets are arranged in succession, substantially parallel and spaced one from other, and vice versa.

When said three-dimensional postcard is in said second position, the image that an observer sees is given by the succession of the images shown on each sheet.

A disadvantage of said second example of three-dimensional postcard of known type is given by the fact that the sensation of depth in the observer of said three-dimensional postcard is reduced.

In fact, an observer placed in front of said three-dimensional postcard slightly perceives the distance between the individual sheets constituting said three-dimensional postcard.

Consequently, the three-dimensional effect, generated by said second example of three-dimensional postcard, although superior to that generated by the first example of a three-dimensional postcard of known type, is anyhow limited.

The object of the present invention is to overcome said disadvantages by providing an article configured to reproduce a predetermined image with a greater three-dimensional effect than that generated by articles of known type.

In particular, said article is configured to reproduce said predetermined image in such a way that from the visual point it offers an observer, when said article is in use, a sensation of depth greater than an article of known type.

it is therefore object of the invention an article for reproducing a predetermined image with three-dimensional effect, where said article comprise a succession of sheets comprising at least:

- a first sheet having a first surface, on which a first part of said predetermined image is shown, and a second surface, opposite to said first surface,
- a second sheet having a first surface, on which a second part of said predetermined image is shown, and a second surface, opposite to said first surface, where said second part of said predetermined image comprises:
  - a first portion showing a first image reproducing said first part of said predetermined image in shadow, and
  - a second portion showing a second image, different from said first image.

Said first sheet has at least one opening or portion of transparent material having predetermined dimensions, and said article is configured in such a way that, when in use, said second sheet is parallel or substantially parallel to said first sheet and is aligned to said first sheet along an axis, perpendicular to said first sheet and to said second sheet, said first surface of said second sheet is at a predetermined first distance from the second surface of said first sheet, said at least one opening or portion of transparent material is arranged with respect to the first surface of said second sheet in such a way that said second portion of said second part is visible from the outside and the projection along said axis of said first part of said predetermined image shown on the first surface of said first sheet falls on the first surface of said second sheet substantially in correspondence of said first portion of said second part.

Said succession of sheets can comprise a third sheet having a first surface, on which a third part of said predetermined image is shown, where said third part of said predetermined image comprises:

- a first portion (13A) showing a third image reproducing said second part (12) of said predetermined image in shadow,
- a second portion (13B) showing a fourth image, different from said third image.

Said second sheet has at least one further opening or further portion of transparent material having predetermined further dimensions, and said article is configured in such a way that, when in use, said third sheet is parallel or substantially parallel to said first sheet and said second sheet and is aligned to said first sheet and said second sheet along said axis, perpendicular to said third sheet, said first surface of said third sheet is at a predetermined second distance from the second surface of said second sheet, and said at least one further opening or further portion of transparent material is arranged with respect to the first surface of said third sheet in such a way that said second portion of said third part is visible from the outside and the projection along said axis of said second part of said predetermined image shown on the first surface of said second sheet falls on the first surface of said third sheet substantially in correspondence of said first portion of said third part.

When said article comprises the first sheet and the second sheet, said first sheet and said second sheet can be connected with each other in such a way that said article moves from a first position, in which said article has a substantially flat shape, where said first sheet and said second sheet are substantially overlapped and in contact with each other, to a second position, in which said article has a three-dimensional shape, where said second sheet is parallel or substantially parallel to said first sheet and aligned to said first sheet along said axis, and said first surface of said second sheet is at a predetermined first distance from the second surface of said first sheet, and vice versa.

When said article comprises the first sheet, the second sheet and the third sheet, said first sheet, said second sheet and said third sheet can be connected with each other in such a way that said article moves from a first position, in which said article has a substantially flat shape, where said first sheet, said second sheet and said third sheet are substantially overlapped and in contact with each other, to a second position, in which said article has a three-dimensional shape, where said third sheet is parallel or substantially parallel to said first sheet and said second sheet and aligned to said first sheet and said second sheet along said axis, and the first surface of said second sheet is at a predetermined first distance from the second surface of said first sheet and the first surface of said third sheet is at a predetermined second distance from the second surface of said second sheet, and vice versa.

In a first alternative, each sheet of said succession of sheets can be a paper sheet.

In a second alternative, each sheet of said succession of sheets can be made of a material having a predetermined degree of rigidity, such as a plastic material, preferably Plexiglass©, or a metallic material or wood or glass.

The present invention relates also to a method for producing an article showing a predetermined image with three-dimensional effect, where said method comprises the following steps:

A) providing a first sheet having a first surface on which a first part of said predetermined image is shown, and a second surface, opposite to said first surface, said first sheet having at least one opening or portion of transparent material having predetermined dimensions, B) providing a second sheet having a first surface, on which a second part of said predetermined image is shown, and a second surface, opposite to said first surface is represented, where said second part of said predetermined image comprises:

a first portion showing a first image reproducing said first part of said predetermined image (11) in shadow, and a second portion showing a second image, different from said first image, C) arranging said second sheet in succession to said first sheet in such a way that, when in use, said second sheet is parallel or substantially parallel to said first sheet and aligned to said first sheet along an axis, perpendicular to said first sheet and to said second sheet, that said first surface of the second sheet is at a predetermined first distance from said second surface of said first sheet, and that said second portion of said second part is visible from the outside through said at least one aperture or portion of transparent material and the projection along said axis of said first part of said predetermined image shown on the first surface of said first sheet falls on the first surface of said second sheet substantially in correspondence of said first portion of said second part.

With respect to the steps A), B) and C), said method can comprise the following step:

D) connecting a first side edge of said first sheet to a first side edge of said second sheet and a second side edge of said first sheet to a second side edge of said second sheet in such a way that said article moves from a first position, in which said article has a substantially flat shape, where said first sheet and said second sheet are substantially overlapped and in contact with each other, to a second position, in which said article has a three-dimensional shape, where said second sheet is arranged in succession to the first sheet so as to be parallel or substantially parallel to said first sheet and aligned with said first sheet along said axis, perpendicular to said first sheet and said second sheet, where the first surface of said second sheet is at a predetermined first distance from the second surface of said first sheet, and vice versa.

Said second sheet can have at least one further opening or further portion of transparent material having predetermined further dimensions and said method can comprise the following steps:

providing a third sheet having a first surface, on which a third part of said predetermined image is shown, where said third part of said predetermined image comprises:

a first portion showing a third image reproducing said second part of said predetermined image in shadow, a second portion showing a fourth image, different from said third image, arranging said third sheet in succession to said second sheet in such a way that, when in use, said third sheet is parallel or substantially parallel to said first sheet and said second sheet and aligned to said first sheet and said second sheet along said axis, perpendicular to said first sheet, said second sheet and to said third sheet, that said first surface of the third sheet is at a predetermined second distance from the second surface of the second sheet, and that said second portion of said third part is visible from the outside through said at least one further opening or further portion of transparent material and the projection along said axis of said second part of said predetermined image shown on the first surface of said second sheet falls on the first surface of said third sheet substantially in correspondence of said first portion of said third part.

With respect to the steps A), B) and C), said method can comprise the following step:

D') connecting a first side edge of said first sheet and a first side edge of said second sheet to a respective portion of a first side edge of said third sheet, as well as a second side edge of said first sheet and a second side edge of said second sheet to a respective further portion of a second side edge of said third sheet in such a way that said article moves from a first position, in which said article has a substantially flat shape, where said first sheet, said second sheet and said third sheet are substantially overlapped and in contact with each other, to a second position, in which said article has a three-dimensional shape, where said third sheet is arranged in succession to the second sheet, parallel or substantially parallel to said second sheet and aligned along said axis, perpendicular to said second sheet and said third sheet, and said first surface of said third sheet is at a predetermined second distance from said second surface of said second sheet, and vice versa.

Below, the description will refer to a three-dimensional postcard.

However, the present invention may relate, with the same advantages, to any article configured to reproduce a predetermined image with three-dimensional effect, without thereby departing from the scope of the invention.

The present invention will be now described, for illustrative, but not limitative purposes, according to its embodiment, making particular reference to the enclosed figures, wherein.

Figure 1:
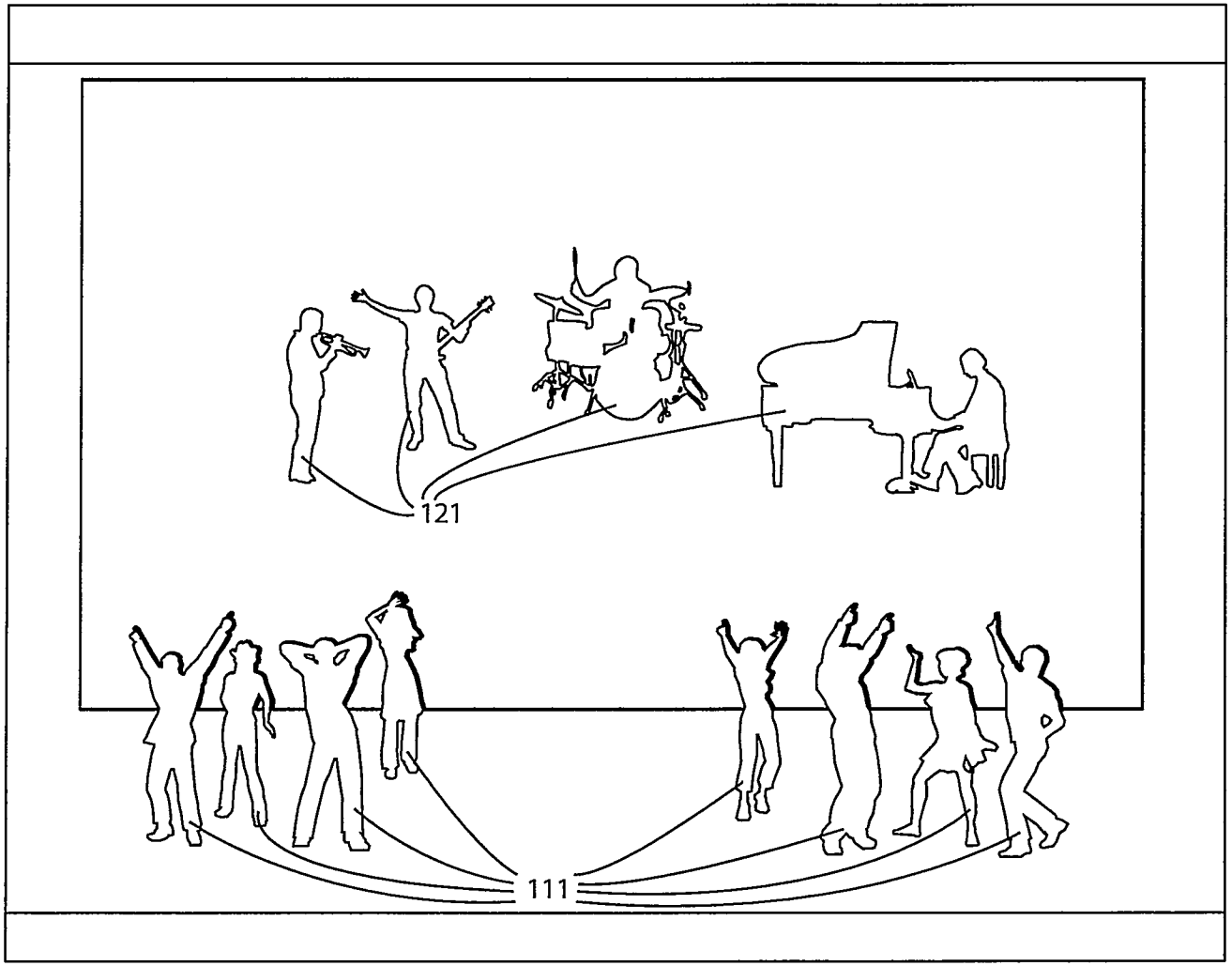
FIG. 1 is a front view of a first embodiment of a three-dimensional postcard, comprising a first sheet and a second sheet.
Figures 2A, 2B:
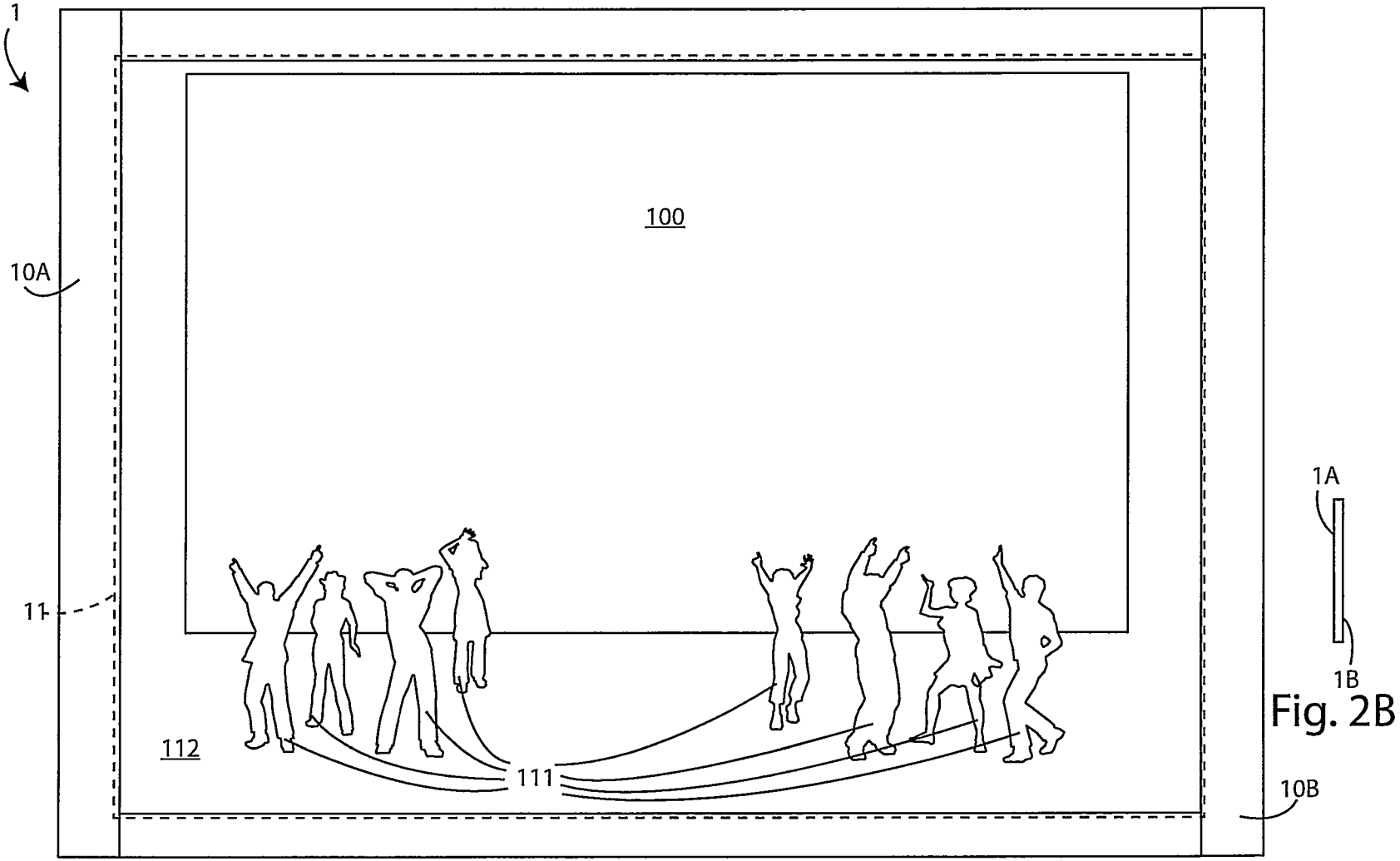
FIGS. 2A and 2B show respectively a front view and a side view of the first sheet of the three-dimensional postcard of FIG. 1A.

With particular reference to FIGS. 1,2A,2B,3A,3B, a first embodiment of a three-dimensional postcard C reproducing a predetermined image with a three-dimensional effect is disclosed.

Said three-dimensional postcard C comprises a succession of sheets, where said succession of sheets comprises at least:

- a first sheet 1 having a first surface 1A on which a first part 11 of said predetermined image is shown, and a second surface 1B, opposite to said first surface 1A,
- a second sheet 2 having a first surface 2A, on which a second part 12 of said predetermined image is shown, and a second surface 2B, opposite to said first surface 2A, where said second part 12 of said predetermined image comprises:
  - a first portion 12A showing a first image reproducing said first part 11 of said predetermined image in shadow, and
  - a second portion 12B showing a second image, different from said first image.

With reference to the first part 11 of said predetermined image, said first part 11 of said predetermined image comprises one or more first characters 111 arranged on a first background 112.

In particular, in the first embodiment being disclosed, said first part 11 comprises a plurality of the first characters 111 and each first character of said plurality of first characters 111 is a dancer.

With reference to the second part 12 of said predetermined image, said first portion 12A reproduce said first characters 111 in shadow and said first background 112 and said second portion 12B shows a second image comprising one or more second characters 121 arranged on a second background.

In particular, said second portion 12B comprises a plurality of second characters 121 and each of said second characters 121 of said plurality of second characters is a musician.

Furthermore, with reference to the first sheet 1, said first sheet has at least a portion 100 having a predetermined dimensions, configured to allow an observer to see through said at least a portion 100 a respective portion of said second sheet.

In the first embodiment being disclosed, said at least one portion 100 is defined by an opening.

Such an opening is arranged with respect to the first surface 2A of said second sheet 2 in such a way that, when said three-dimensional postcard C is in use, the second portion 12B of said second part 12 is visible from the outside, so that an observer can see it.

In particular, in the first embodiment being disclosed, said opening is arranged on the first sheet 1 in such a way that it intercepts each of said first characters 111 shown on the first surface 1A of the first sheet 1 and allow an observer to see each of second characters 121 shown on the first surface 2A of the second sheet 2.

However, said at least one portion 100 can be a portion of transparent material, without departing from the scope of the invention.

In particular, said three-dimensional postcard C is configured in such a way that, when in use, said second sheet 2 is arranged in succession to the first sheet in such a way that said second sheet is parallel or substantially parallel to said first sheet 1 and is aligned to said first sheet 1 along an axis A, perpendicular to said first sheet 1 and to said second sheet 2, and that said first surface 2A of said second sheet 2 is at a predetermined first distance from the second surface 1B of said first sheet 1. Furthermore, when in use, said second portion 12B of said part 12 is visible from the outside through said at least one opening or portion of transparent material 100 and the projection along said axis A of said first part 11 of said predetermined image shown on the first surface 1A of said first sheet 1 falls on the first surface 2A of said second sheet 2 substantially in correspondence of said first portion 12A of said second part 12.

In this way, the predetermined image that three-dimensional postcard C allows to view is the result of the succession of the images shown on each sheet.

The fact that, on the second sheet 2, the first portion 12A of the second part 12 of said predetermined image showing a first image (corresponding to the first part 11 shown on the first surface 1A of the first sheet 1) is in shadow amplifies the three-dimensional effect generated by the said three-dimensional postcard C.

In fact, the observer looking at the three-dimensional postcard C has a greater sensation of depth as a portion not in shadow alternated with a portion in shadow highlights a perspective effect, as well as a correct alternance of lights and shadows.

In the first embodiment being disclosed, said first sheet 1 and said second sheet 2 have respectively a first side edge 10A, 20A and a second side edge 10B,20B.

Figure 4B:
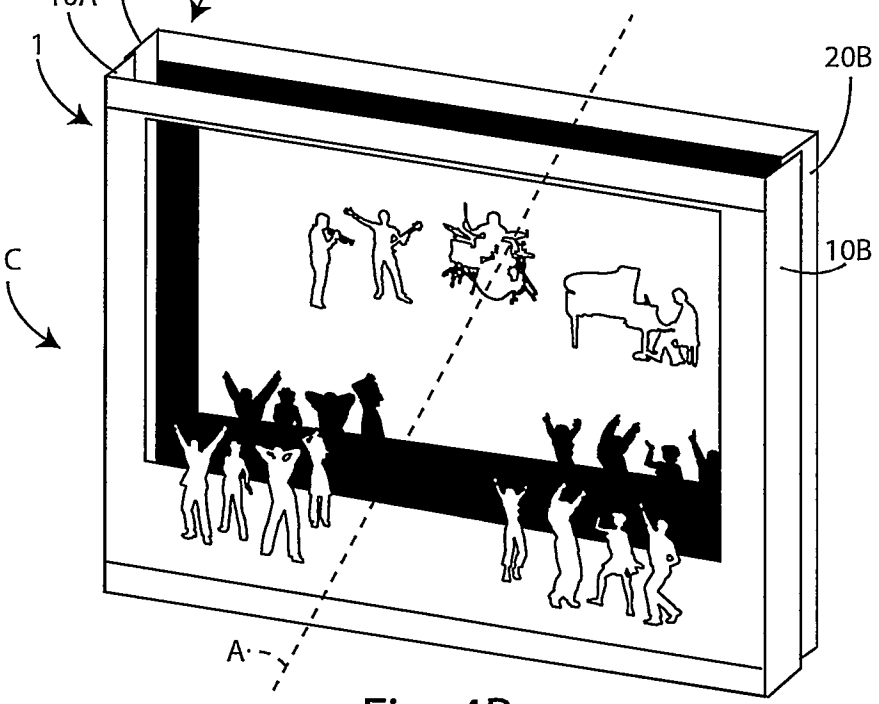
FIGS. 4A and 4B show respectively the three-dimensional postcard of FIG. 1A in a first position and in a second position.
Figure 4A:
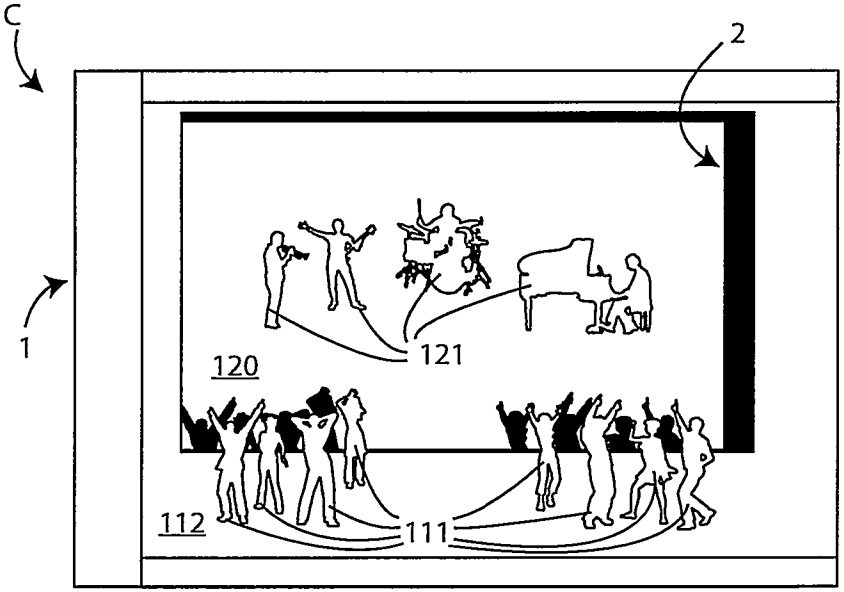
Figure 5:
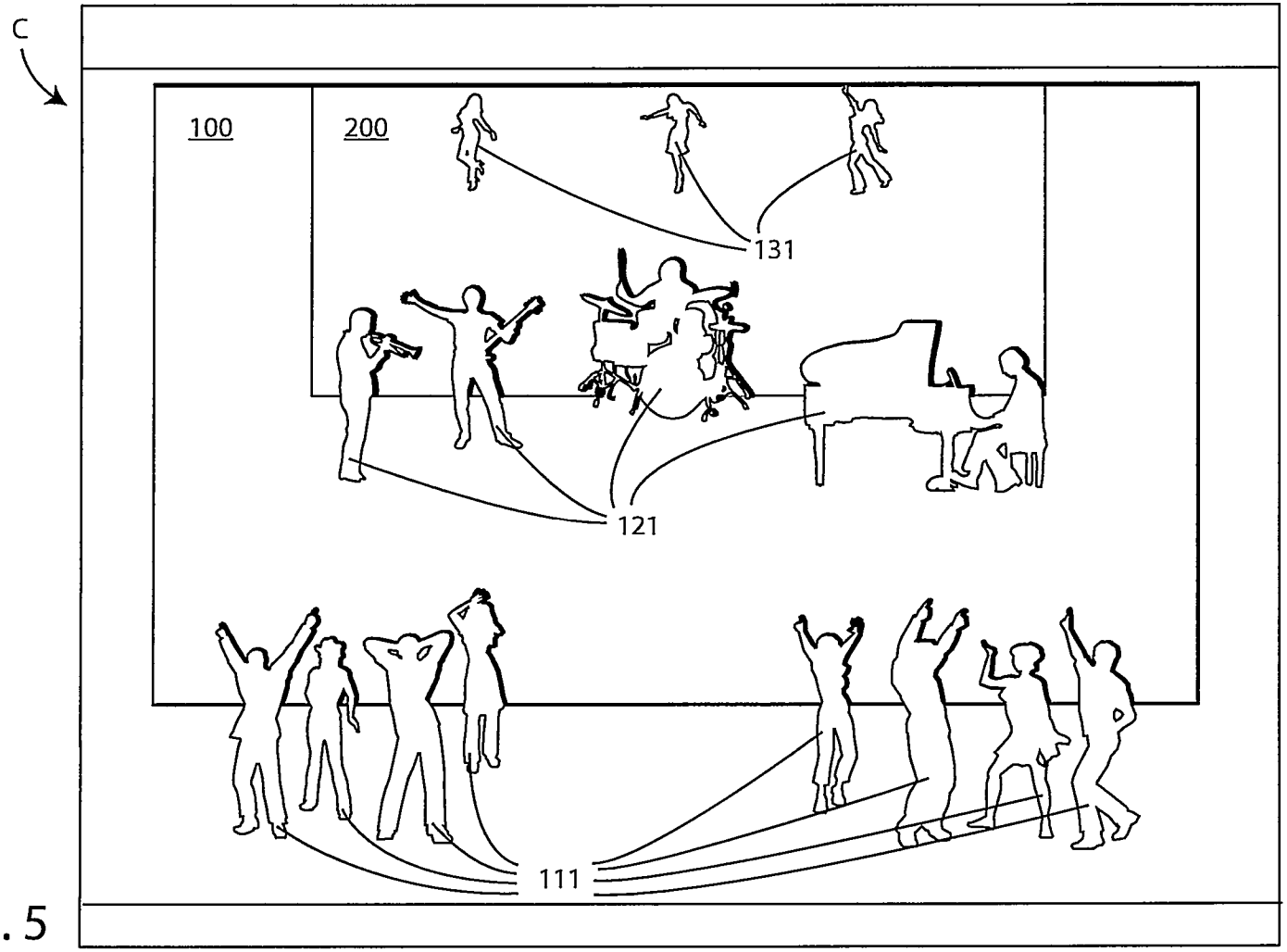
FIG. 5 is a front view of a second embodiment of a three-dimensional postcard, comprising a first sheet, a second sheet and a third sheet.
Figure 6:
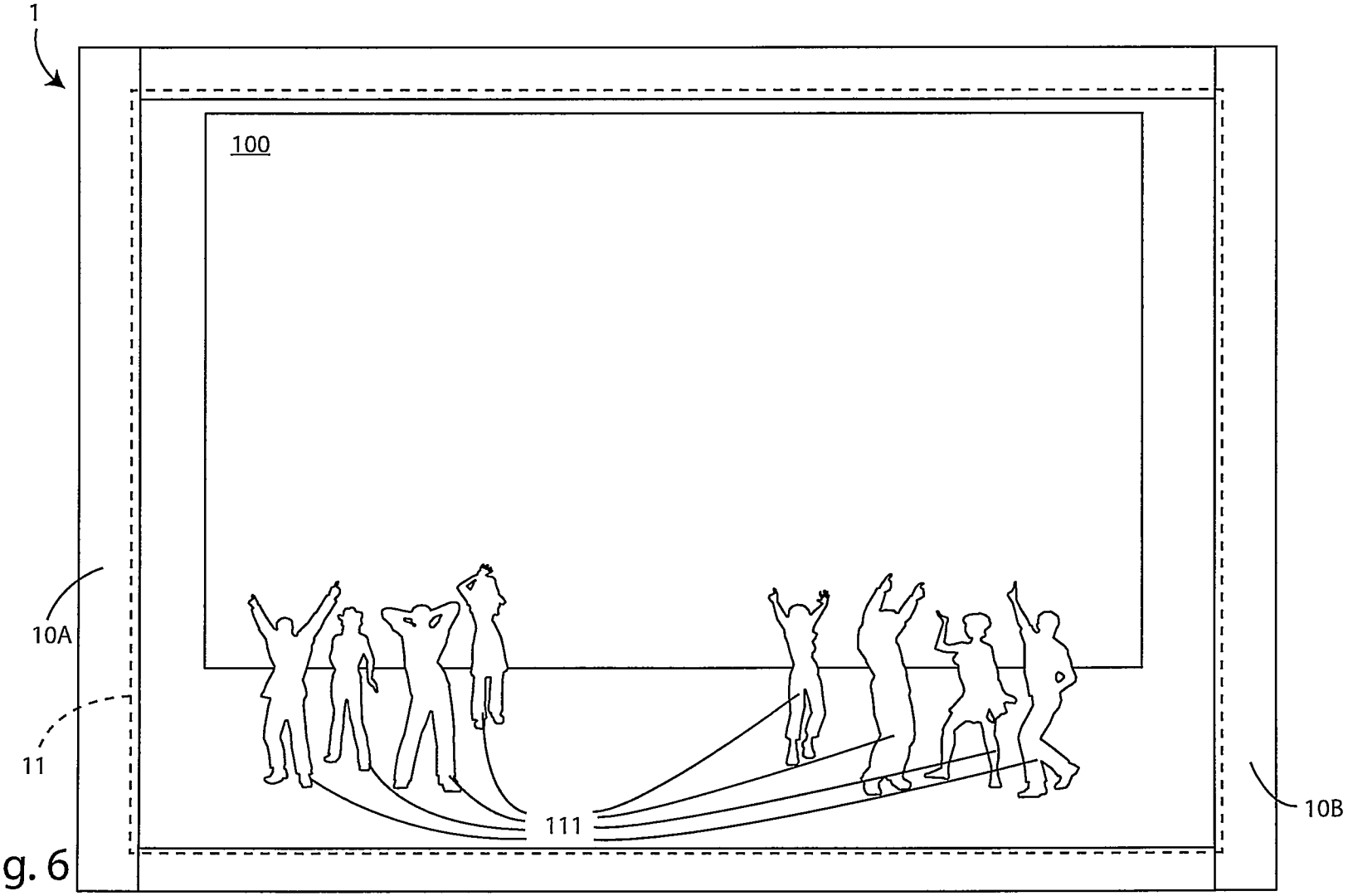
FIG. 6 is a front view of the first sheet of the three-dimensional postcard of the FIG. 5.
Figure 7:
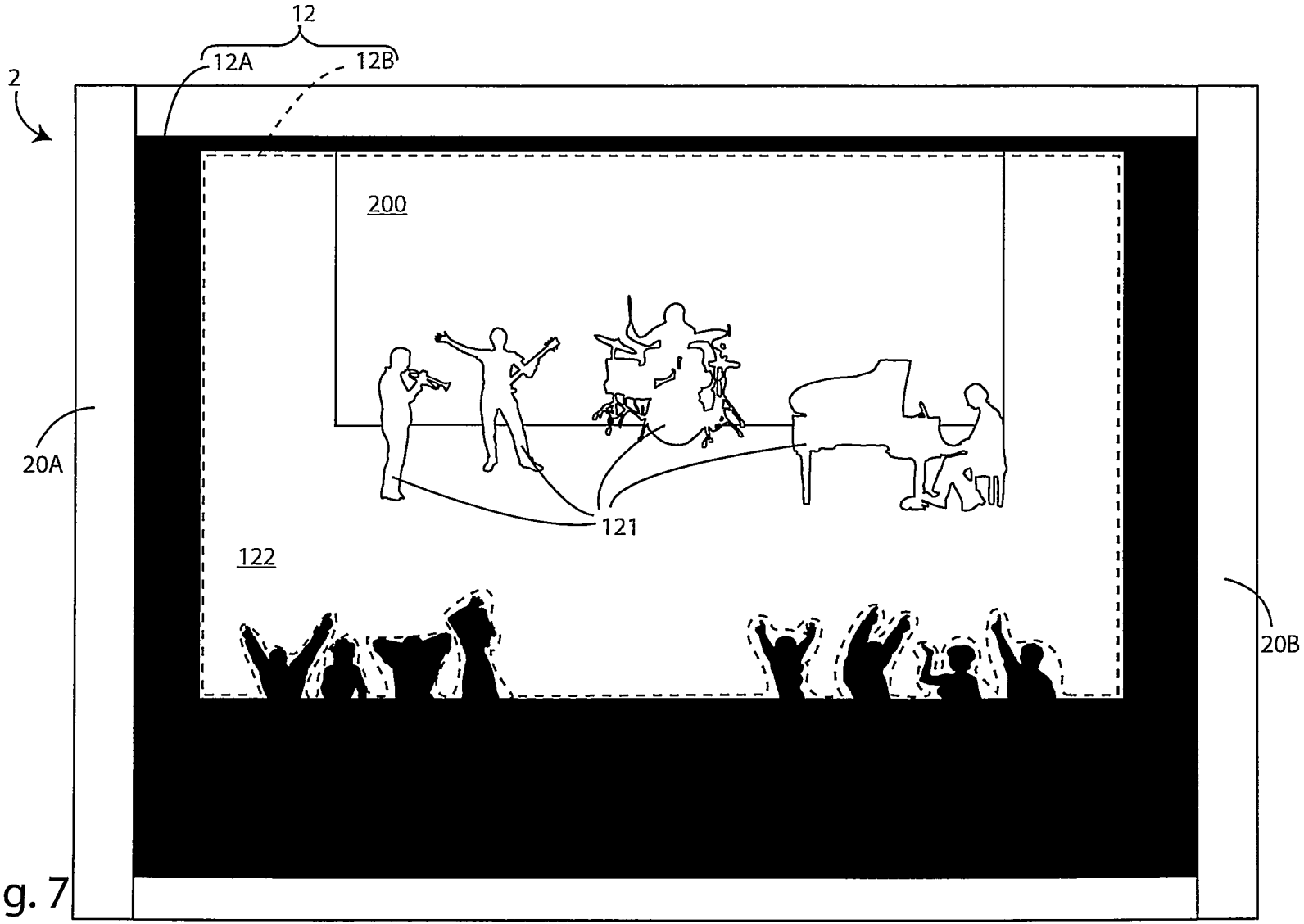
FIG. 7 is a front view of the second sheet of the three-dimensional postcard of the FIG. 5.
Figure 8B:
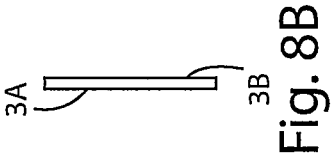
FIGS. 8A and 8B show respectively a front view and a side view of the third sheet of the three-dimensional postcard of the FIG. 5.
Figure 8A:
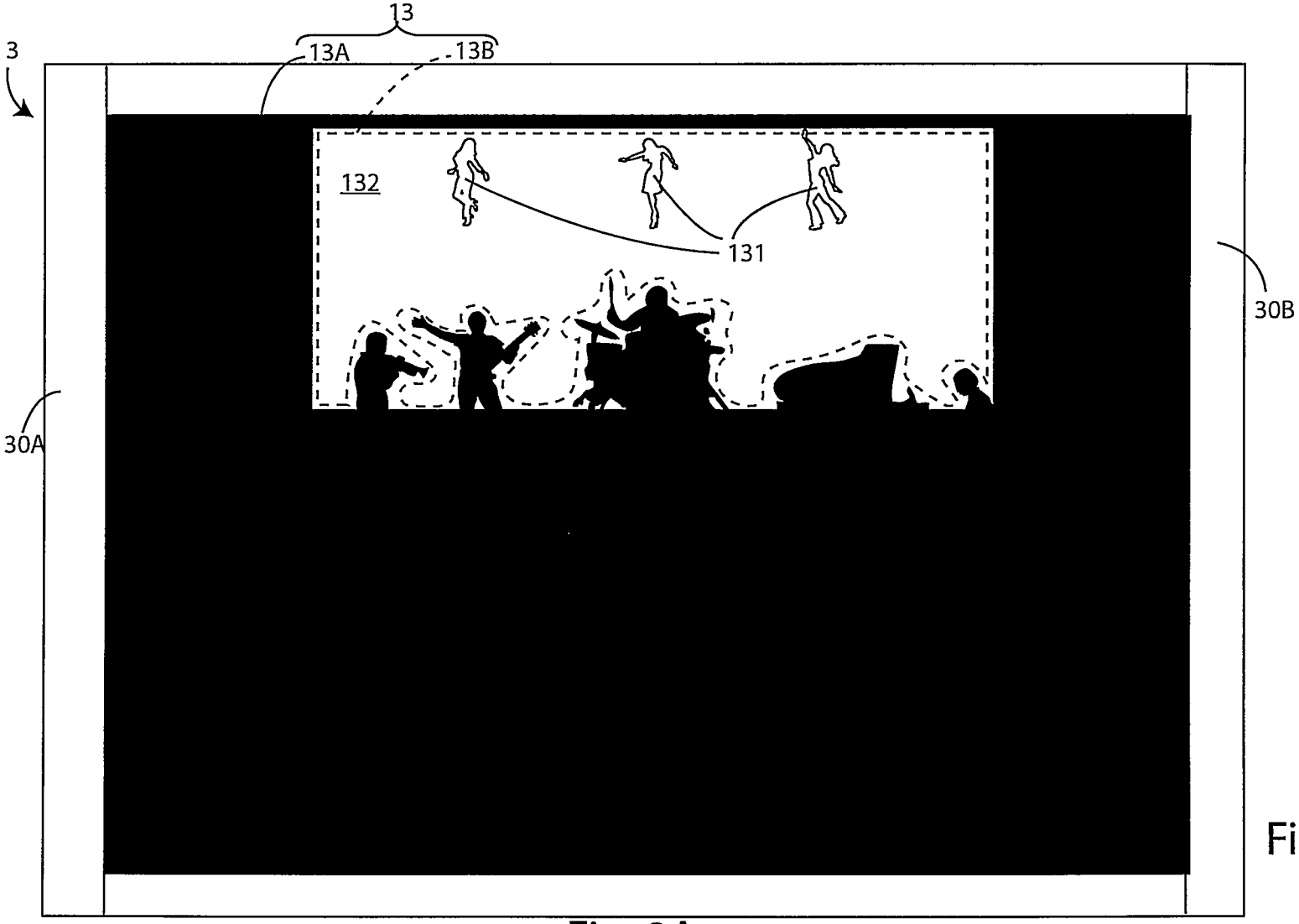
Figure 9:
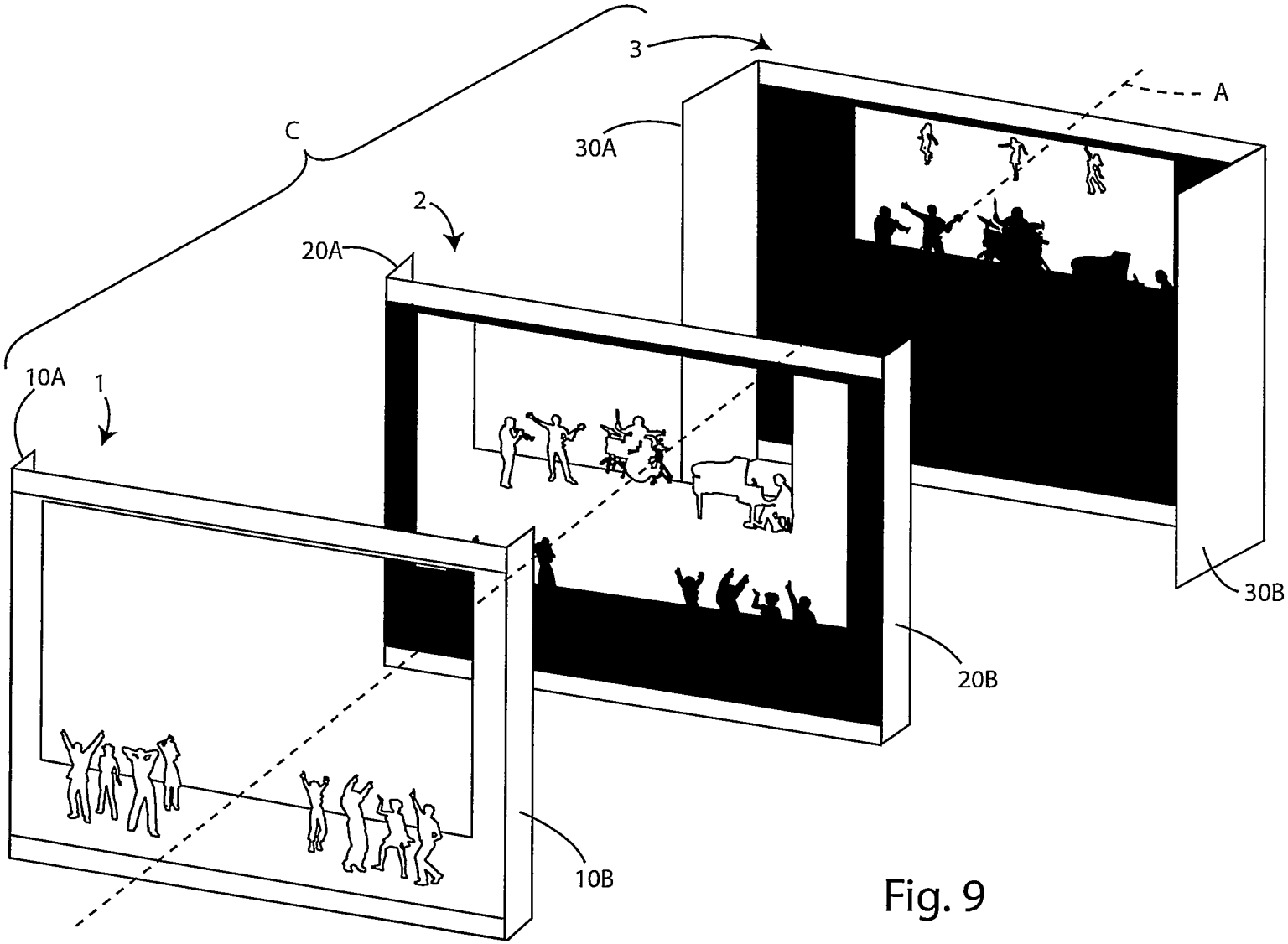
FIG. 9 shows the three sheets of the three-dimensional postcard of FIG. 5 before they are jointed each other.

The first sheet 1 and the second sheet 2 are connected to each other in such a way that said three-dimensional postcard C moves from a first position, in which said three-dimensional postcard C has a substantially flat shape, where said first sheet 1 and said second sheet 2 are substantially overlapped and in contact with each other (FIG. 4A), to a second position, in which said three-dimensional postcard C has a three-dimensional shape, where said second sheet 2 is parallel or substantially parallel to said first sheet 1 and aligned to said first sheet 1 along said axis A, perpendicular to said first sheet 1 and said second sheet 2 (FIG. 4B), and vice versa.

In particular, the first side edge 10A and the second side edge 10B of the first sheet 1 are connected respectively to the first side edge 20A and to the second side edge 20B of the second sheet 2.

Figures 3A, 3B:
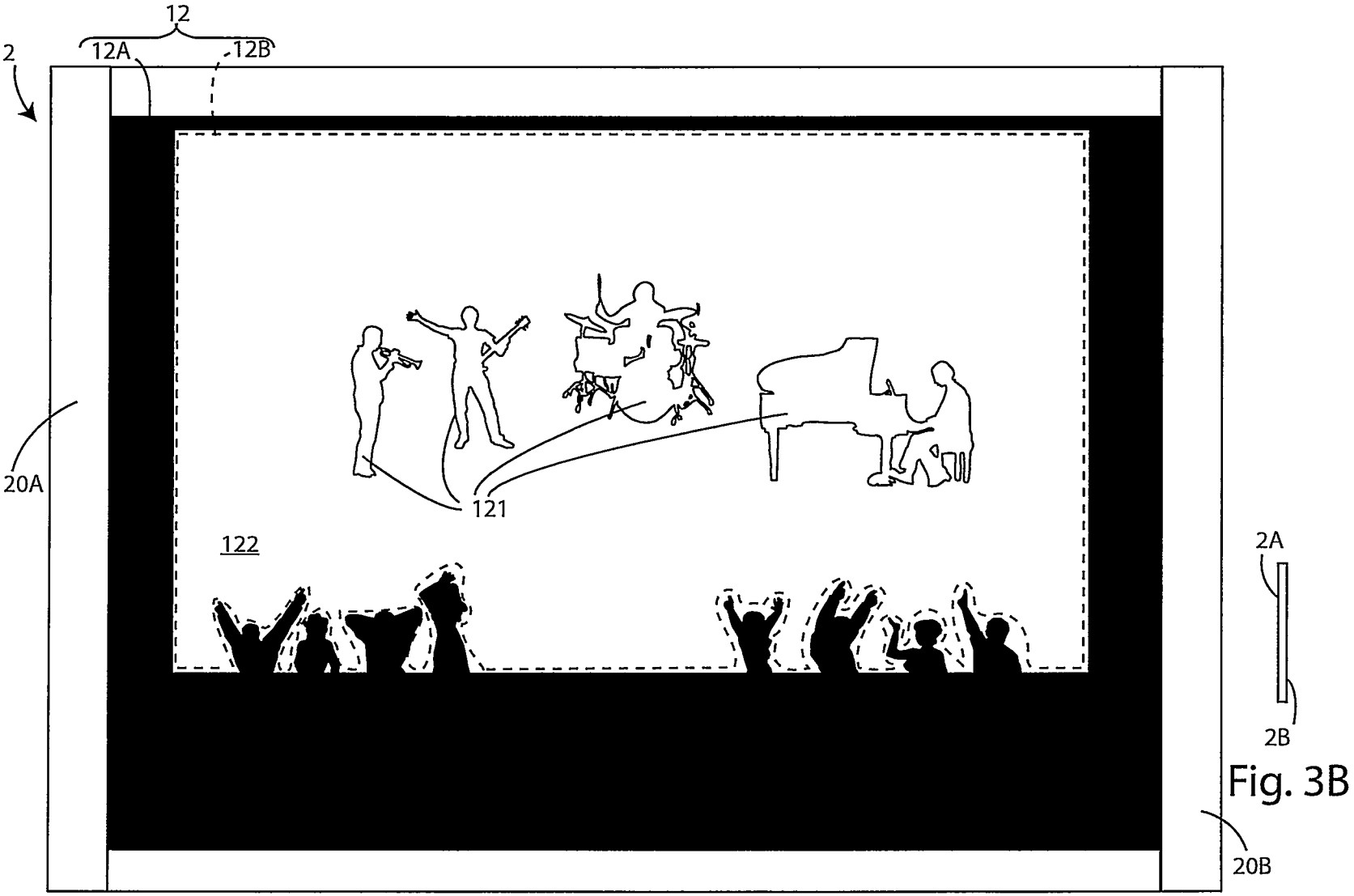
FIGS. 3A and 3B show respectively a front view and a side view of the second sheet of the three-dimensional postcard of FIG. 1A.

Furthermore, when said three-dimensional postcard C is in said second position, the first surface 2A of said second sheet 2 is at a predetermined first distance from the second surface 1B of said first sheet 1 (as it can be seen from the FIG. 3B).

However, it is not necessary that said three-dimensional postcard C is configured to move from said first position to said second position, and vice versa.

As it can be seen from the Figures concerning said first embodiment, on the second sheet a second part of said predetermined image is shown and a portion of said second part of said predetermined image corresponds to the image shown on the first sheet but characterized by the fact of being in shadow.

The predetermined image reproduced by said three-dimensional postcard C is thus broken up in a plurality of planes arranged in a succession and spaced each other, on each of them a respective part of said predetermined image having a portion in shadow is shown, apart from the first plane.

The fact that, on each sheet, subsequent to the first sheet, a respective image having a portion in shadow is shown, equal to the image shown on the previous sheet of the successions of sheets, generates an amplified three-dimensional effect.

Furthermore, although in the embodiment being disclosed, said three-dimensional postcard C is in paper material, and then the sheets of said three-dimensional postcard C are paper sheets, said three-dimensional postcard C can be in any material, without departing from the scope of the invention.

In fact, said sheets can be made of a material having a predetermined degree of rigidity.

For example, said sheets can be made of wood or metal or a plastic material, preferably Plexiglass©, or glass.

In case of said three-dimensional postcard comprises sheets made of transparent plastic material or glass, said first sheet 1 has no opening.

The important thing is that each sheet of said succession of sheets show a part of said predetermined image, and that, apart from the first sheet 1, a portion of said part is in shadow and the image shown on said portion corresponds to that shown on the previous sheet.

The method for producing a three-dimensional postcard C showing a predetermined image, comprises the following steps:

A) providing a first sheet 1 having a first surface 1A on which a first part 11 of said predetermined image is shown, and a second surface 1B, opposite to said first surface 1A, said first sheet 1 having at least one opening or portion of transparent material 100 having predetermined dimensions, B) providing a second sheet 2 having a first surface 2A, on which a second part 12 of said predetermined image is shown, and a second surface 2B, opposite to said first surface 2A, and said second part 12 of said predetermined image comprises:

a first portion 12A showing a first image reproducing said first part 11 of said predetermined image 11 in shadow, and a second portion 12B showing a second image, different from said first image, C) arranging said second sheet 2 in succession to said first sheet 1 in such a way that, when in use, said second sheet 2 is parallel or substantially parallel to said first sheet 1 and aligned to said first sheet 1 along an axis A, perpendicular to said first sheet 1 and to said second sheet 2, that said first surface 2A of the second sheet 2 is at a predetermined first distance from the second surface 1B of the first sheet 1, and that said second portion 12B of said second part 12 is visible from the outside through said at least one aperture or portion of transparent material 100 and the projection along said axis A of said of said first part 11 of said predetermined image shown on the first surface 1A of said first sheet 1 falls on the first surface 2A of said second sheet 2 substantially in correspondence of said first portion 12A of said second part 12.

Said method can comprises a step D), i.e. the step of connecting the first sheet 1 to the second sheet 2 in such a way that said three-dimensional postcard C moves from a first position, in which said three-dimensional postcard C has a substantially flat shape, where said first sheet 1 and said second sheet 2 are substantially overlapped and in contact with each other, to a second position, in which said three-dimensional postcard C has a three-dimensional shape, where said second sheet 2 is arranged in succession to the first sheet 1 so as to be parallel or substantially parallel to said first sheet 1 and aligned with said first sheet 1 along said axis A, perpendicular to said first sheet 1 and said second sheet 2, and the first surface 2A of said second sheet 2 is at a predetermined first distance from the second surface 1B of said first sheet 1, and vice versa.

In particular, the first side edge 10A and the second side edge 10B of the first sheet 1 are connected respectively to the first side edge 20A and the second side edge 20B of said second sheet 2.

More particularly, the first side edge 10A and the second side edge 10B of the first sheet 1 are glued respectively to the first side edge 20A and to the second side edge 20B of said second sheet 2

Although the first embodiment refers to a three-dimensional postcard C comprising two sheets, said three-dimensional postcard C can comprise a plurality of sheets, the number of which is greater or equal to two sheets.

Furthermore, as already said, three-dimensional postcard C is only an example of an article configured to reproduce a predetermined image con three-dimensional effect.

In the second embodiment, shown in the FIGS. 5,6,7,8A, 8B,9, differently from the first embodiment above disclosed, the three-dimensional postcard C comprises three sheets.

As a consequence, said three-dimensional postcard C comprises a third sheet in addition to the first sheet 1 and to the second sheet 2, mentioned with reference to the first embodiment.

Said third sheet 3 has a first surface 3A, on which a third part 13 of said predetermined image is shown, where said third part 13 of said predetermined image comprises:

a first portion 13A showing a third image reproducing said second part 12 of said predetermined image in shadow, a second portion 13B showing a fourth image, different from said third image With reference to the third part 13 of said predetermined image, said first portion 13A reproduces said second characters in shadow and said second background 122, and said second portion 13B shows a fourth image comprising one or more third characters 131 arranged on a third background 132.

In particular, said second portion 13B comprises a plurality of third characters 121 and each of said third characters 131 of said plurality of third characters is a dancer.

Said second sheet 2 has at least a further portion 200 having predetermined further dimensions, configured to allow an observer to see through said at least one further portion 200 a respective portion of said third sheet 3.

In the second embodiment being disclosed, said at least one further portion 200 is defined by a further opening.

Such a further opening is arranged with respect to the first surface 3A of said third sheet 3 in such a way that, when said three-dimensional postcard C is in use, the second portion 13B of said third part 3 is visible from the outside, so that an observer can see it.

In particular, said opening 100 on the first sheet 1 and said further opening 200 on the second sheet 2 are arranged in such a way that the projection of said opening 100 along said axis A falls within of said further opening 200.

More particularly, in the second embodiment being disclosed, said further opening 200 is arranged on the third sheet 3, in such a way that it intercepts each of said second characters 121 shown on the first surface 2A of the second sheet 2 and allow an observer to see each of said third characters 131 shown on the first surface 3A of said third sheet 3.

However, said at least one further portion 200 can be a further portion of transparent material, without departing from the invention.

Similarly to the first embodiment above disclosed, said three-dimensional postcard C is configured in such a way that, when in use, said third sheet 3 is parallel or substantially parallel to said first sheet 1 and said second sheet 2 and aligned to said first sheet 1 and said second sheet 2 along said axis A, perpendicular to said first sheet 1, said second sheet 2 and also to said third sheet 3. Furthermore, the first surface 3A of said third sheet 3 is at a predetermined second distance from the second surface 2B of said second sheet 2.

In other words, with reference to said second embodiment concerning a three-dimensional postcard C comprising three sheets arranged in succession, a second part 12 of said predetermined image is shown on the second sheet 2, and a portion 12A of said second part reproduces the image shown on the first sheet 1 in shadow, and a third part 13 of said predetermined image is shown on the third sheet and a portion 13A of said third part reproduces the image shown on the second sheet 2 in shadow.

With respect to the method disclosed for the first embodiment, with reference to a three-dimensional postcard comprising three sheets, where the second sheet has a further opening 200, the method further comprises the following steps:

- providing a third sheet 3 having a first surface 3A, on which a third part 13 of said predetermined image is shown, where said third part 13 of said predetermined image comprises:
  - a first portion 13A showing a third image reproducing said second part 12 of said predetermined image in shadow,
  - a second portion 13B showing a fourth image, different from said third image,
- arranging said third sheet 3 in succession to said second sheet 2 in such a way that, when in use, said third sheet 3 is parallel or substantially parallel to said first sheet 1 and said second sheet 2 and aligned to said first sheet 1 and said second sheet 2 along said axis A, perpendicular to said first sheet 1, said second sheet 2 and to said third sheet 3, that said first surface 3A of the third sheet 3 is at a predetermined second distance from the second surface 2B of the second sheet 2, and that said second portion 13B of said third part 13 is visible from the outside through said at least one further opening or further portion of transparent material 200 and the projection along said axis A of said second part 11 of said predetermined image shown on the first surface 2A of said second sheet 2 falls on the first surface 3A of said third sheet 3 substantially in correspondence of said first portion 13A of said third part 13.

The third sheet 3 has a side edge 30A and a second side edge 30B.

In the second embodiment being disclosed, said first sheet 1, said second sheet 2 and said third sheet 3 are connected to each other in such a way that said three-dimensional postcard C moves from a first position, in which said three-dimensional postcard has a substantially flat shape, where the first sheet 1, the second sheet 2 and the third sheet 3 are substantially overlapped and in contact with each other, to a second position, in which said three-dimensional postcard C has a three-dimensional shape, where said third sheet 2 is parallel or substantially parallel to said second sheet 2 and aligned along said axis A, and the first surface 3A of the third sheet 3 is at a predetermined second distance from the second surface 2B of said second sheet 2, and vice versa.

In particular, the side edge 10A and the second side edge 10B of the first sheet 1 are connected respectively to a respective portion of the first side edge 30A and to a second side edge 30B of the third sheet 3, and the first side edge 20A and the second side edge 20B of the second sheet 2 are connected respectively to a respective further portion of the first side edge 30A and the second side edge 30B of the third sheet 3.

Similarly to the step D), said method can comprise the step D'), i.e. the step of connecting said first sheet 1, said second sheet 2 and said third sheet 3 each other, in such a way that said three-dimensional postcard C moves from a first position, in which said three-dimensional postcard C has a substantially flat shape, where said first sheet 1, said second sheet 2 and said third sheet 3 are substantially overlapped and in contact with each other, to a second position, in which said three-dimensional postcard C has a three-dimensional shape, where said third sheet 3 is arranged in succession to the second sheet 2, parallel or substantially parallel to said first sheet 1 and second sheet 2 and aligned to said first sheet 1 and to said second sheet 2 along said axis A, perpendicular to said first sheet 1, said second sheet 2 and also said third sheet 3, and said first surface 3A of said third sheet 3 is at a predetermined second distance from said second surface 2B of said second sheet 2, and vice versa.

In particular, the first side edge 10A of said first sheet 1 and the first side edge 20A of said second sheet 2 are connected to a respective portion of the first side edge 30A of said third sheet 3, and the second side edge 10B of said first sheet 1 and the second side edge 20B of said second sheet 2 are connected to a respective further portion of the second side edge 30B of said third sheet 3.

More particularly, the first side edge 10A of said first sheet 1 and the first side edge 20A of said second sheet 2 are glued to a respective portion of the first side edge 30A of said third sheet 3, and the second side edge 10B of said first sheet 1 and the second side edge 20B of said second sheet 2 are glued to a respective further portion of the second side edge 30B of said third sheet 3.

Advantageously, as already said, the three-dimensional postcard, object of the invention, is configured to reproduce a predetermined image with a three-dimensional effect greater than the three-dimensional effect rendered by the three-dimensional postcards of known type.

The present invention has been described for illustrative, but not limitative purposes, according to its preferred embodiments, but it is to be understood that variations and/or modifications can be carried out by a skilled in the art, without departing from the scope thereof, as defined according to enclosed claims.

The invention claimed is:

1. Article for reproducing a predetermined image with three-dimensional effect, said article comprising a succession of sheets and said succession of sheets comprising at least:

a first sheet having a first surface, on which a first part of said predetermined image is shown, and a second surface, opposite to said first surface, and a second sheet having a first surface, on which a second part of said predetermined image is shown, and a second surface, opposite to said first surface, said second part of said predetermined image comprising:

a first portion showing a first image reproducing said first part of said predetermined image in shadow, and a second portion showing a second image, different from said first image; wherein:

said first sheet has at least one opening or portion of transparent material having predetermined dimensions, and said article is configured such that said second sheet is parallel or substantially parallel to said first sheet and is aligned to said first sheet along an axis, said axis being perpendicular to said first sheet and to said second sheet, said first surface of said second sheet is at a predetermined first distance from the second surface of said first sheet, said at least one opening or portion of transparent material is arranged with respect to the first surface of said second sheet in such a way that said second portion of said second part is visible from the outside and the projection along said axis of said first part of said predetermined image shown on the first surface of said first sheet falls on the first surface of said second sheet substantially in correspondence of said first portion of said second part.

2. Article according to claim 1, wherein said succession of sheets comprises a third sheet having a first surface, on which a third part of said predetermined image is shown, wherein said third part of said predetermined image comprises:

a first portion showing a third image reproducing said second part of said predetermined image in shadow, and a second portion showing a fourth image, different from said third image, wherein:

said second sheet has at least one further opening or further portion of transparent material having predetermined further dimensions, and said article is configured such that said third sheet is parallel or substantially parallel to said first sheet and said second sheet and is aligned to said first sheet and said second sheet along said axis, said axis being perpendicular to said third sheet, said first surface of said third sheet is at a predetermined second distance from the second surface of said second sheet, and said at least one further opening or further portion of transparent material is arranged with respect to the first surface of said third sheet in such a way that said second portion of said third part is visible from the outside and the projection along said axis of said second part of said predetermined image shown on the first surface of said second sheet falls on the first surface of said third sheet substantially in correspondence of said first portion of said third part.

3. Article according to claim 2, wherein said first sheet, said second sheet and said third sheet are connected with each other in such a way that said article moves from a first position, in which said article has a substantially flat shape, where said first sheet, said second sheet and said third sheet are substantially overlapped and in contact with each other, to a second position, in which said article has a three-dimensional shape, where said third sheet is parallel or substantially parallel to said first sheet and said second sheet and aligned to said first sheet and said second sheet along said axis, and the first surface of said second sheet is at a predetermined first distance from the second surface of said first sheet and the first surface of said third sheet is at a predetermined second distance from the second surface of said second sheet, and vice versa.

4. Article according to claim 1, wherein said first sheet and said second sheet are connected with each other in such a way that said article moves from a first position, in which said article has a substantially flat shape, where said first sheet and said second sheet are substantially overlapped and in contact with each other, to a second position, in which said article has a three-dimensional shape, where said second sheet is parallel or substantially parallel to said first sheet and aligned to said first sheet along said axis, and said first surface of said second sheet is at a predetermined first distance from the second surface of said first sheet, and vice versa.

5. Article according to claim 1, wherein each sheet of said succession of sheets is a paper sheet.

6. Article according to claim 1, wherein each sheet of said succession of sheets is made of a material having a predetermined degree of rigidity.

7. Article according to claim 6, wherein the material comprises plastic material, metallic material, wood, or glass.

8. Article according to claim 7, wherein plastic material comprises plexiglass.

9. Method for producing an article showing a predetermined image with three-dimensional effect, said method comprising:

providing a first sheet having a first surface on which a first part of said predetermined image is shown, and a second surface, opposite to said first surface, said first sheet having at least one opening or portion of transparent material having predetermined dimensions, providing a second sheet having a first surface, on which a second part of said predetermined image is shown, and a second surface, opposite to said first surface, wherein said second part of said predetermined image comprises:

a first portion showing a first image reproducing said first part of said predetermined image in shadow, and a second portion showing a second image, different from said first image, arranging said second sheet in succession to said first sheet such that said second sheet is parallel or substantially parallel to said first sheet and aligned to said first sheet along an axis, perpendicular to said first sheet and to said second sheet, that said first surface of the second sheet is at a predetermined first distance from said second surface of said first sheet, and that said second portion of said second part is visible from the outside through said at least one opening or portion of transparent material and the projection along said axis of said first part of said predetermined image shown on the first surface of said first sheet falls on the first surface of said second sheet substantially in correspondence of said first portion of said second part.

10. Method according to claim 9, further comprising:

connecting a first side edge of said first sheet to a first side edge of said second sheet and a second side edge of said first sheet to a second side edge of said second sheet in such a way that said article moves from a first position, in which said article has a substantially flat shape, where said first sheet and said second sheet are substantially overlapped and in contact with each other, to a second position, in which said article has a three-dimensional shape, where said second sheet is arranged in succession to the first sheet so as to be parallel or substantially parallel to said first sheet and aligned with said first sheet along said axis, perpendicular to said first sheet and said second sheet, where the first surface of said second sheet is at a predetermined first distance from the second surface of said first sheet, and vice versa.

11. Method according to claim 9, wherein said second sheet has at least one further opening or further portion of transparent material having predetermined further dimensions and said method further comprises:

providing a third sheet having a first surface, on which a third part of said predetermined image is shown, wherein said third part of said predetermined image comprises:

a first portion showing a third image reproducing said second part of said predetermined image in shadow, a second portion showing a fourth image, different from said third image, arranging said third sheet in succession to said second sheet such that said third sheet is parallel or substantially parallel to said first sheet and said second sheet and aligned to said first sheet and said second sheet along said axis, perpendicular to said first sheet, said second sheet and to said third sheet, that said first surface of the third sheet is at a predetermined second distance from the second surface of the second sheet, and that said second portion of said third part is visible from the outside through said at least one further opening or further portion of transparent material and the projection along said axis of said second part of said predetermined image shown on the first surface of said second sheet falls on the first surface of said third sheet substantially in correspondence of said first portion of said third part.

12. Method according to claim 11, further comprising:

connecting a first side edge of said first sheet and a first side edge of said second sheet to a respective portion of a first side edge of said third sheet, as well as a second side edge of said first sheet and a second side edge of said second sheet to a respective further portion of a second side edge of said third sheet in such a way that said article moves from a first position, in which said article has a substantially flat shape, where said first sheet, said second sheet and said third sheet are substantially overlapped and in contact with each other, to a second position, in which said article has a three-dimensional shape, where said third sheet is arranged in succession to the second sheet, parallel or substantially parallel to said second sheet and aligned to said second sheet along said axis, perpendicular to said second sheet and said third sheet, and said first surface of said third sheet is at a predetermined second distance from said second surface of said second sheet, and vice versa.

* * * * *